US005512988A

United States Patent [19]

Donaldson

[11] Patent Number: 5,512,988

[45] Date of Patent: Apr. 30, 1996

[54] APPARATUS AND METHOD FOR CONTROLLING DEVELOPMENT OF DEVELOPER MATERIAL ON A PHOTORECEPTIVE MEMBER

[75] Inventor: Patricia J. Donaldson, Pittsford, N.Y.

[73] Assignee: Xerox Corporation, Stamford, Conn.

[21] Appl. No.: 332,153

[22] Filed: Oct. 31, 1994

[51] Int. Cl.[6] ..... G03G 15/06

[52] U.S. Cl. ..... 355/260; 355/208; 355/246

[58] Field of Search ..... 355/200, 210, 355/208, 245, 246, 260, 326 R, 327, 328

[56] References Cited

U.S. PATENT DOCUMENTS

| | | | |
|---|---|---|---|
| 4,078,929 | 3/1978 | Gundlach | 96/1.2 |
| 4,961,088 | 10/1990 | Gilliland et al. | 355/206 |
| 4,975,747 | 12/1990 | Higuchi | 355/246 |
| 4,989,043 | 1/1991 | Suzuki et al. | 355/246 |
| 4,999,673 | 3/1991 | Bares | 355/208 |
| 5,019,859 | 5/1991 | Nash | 355/77 |
| 5,036,360 | 7/1991 | Paxon et al. | 355/208 |
| 5,150,135 | 9/1992 | Casey et al. | 355/208 X |
| 5,175,590 | 12/1992 | Frankel et al. | 355/296 |
| 5,266,997 | 11/1993 | Nakane et al. | 355/208 |
| 5,272,503 | 12/1993 | Le Sueur et al. | 355/208 |
| 5,283,613 | 2/1994 | Midgley, Sr. | 355/203 |
| 5,365,312 | 11/1994 | Hillmann et al. | 355/260 X |
| 5,386,276 | 1/1995 | Swales et al. | 355/246 |

OTHER PUBLICATIONS

Bober, H. T., "Intelligent Paper Cassette", *Xerox Disclosue Journal,* vol. 18, No. 5, Sep./Oct. 1993, p. 519.

*Primary Examiner*—Sandra L. Brase
*Attorney, Agent, or Firm*—Gary B. Cohen

[57] ABSTRACT

A replaceable cartridge, adapted for use with a printing machine having a photoreceptor, is provided. The replaceable cartridge includes a container for storing a selected developer material different from a developer material previously in the printing machine and a programmable memory unit communicating with a control system. The programmable memory is programmed with a reference value reflecting a desired amount of developer material to be developed on the photoreceptor. In operation, the control system detects an actual amount of developer material developed on the photoreceptor and reads the reference value to determine if a difference exists between a value representative of the detected actual amount and the reference value. When a difference exists and the difference is greater than a selected magnitude, a setpoint of the printing machine is adjusted.

23 Claims, 6 Drawing Sheets

APPARATUS AND METHOD FOR CONTROLLING DEVELOPMENT OF DEVELOPER MATERIAL ON A PHOTORECEPTIVE MEMBER

BACKGROUND OF THE INVENTION

The present invention relates generally to a replaceable cartridge for a printing machine and more particularly to a technique for controlling a degree to which developer material is developed on a photoreceptive member of the printing machine.

In electrophotographic applications such as xerography, a charge retentive surface is electrostatically charged and exposed to a light pattern of an original image to be reproduced for selectively discharging the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development and transfer, excess toner left on the charge retentive surface is cleaned from the surface. The process is well known, and useful for light lens copying from an original, and printing applications from electronically generated or stored originals, where a charged surface may be imagewise discharged in a variety of ways.

A process referred to as "highlight color imaging" has been accomplished by employing basic xerographic techniques. The concept of tri-level, highlight color xerography is described in the following patent:

U.S. Pat. No. 4,078,929

Patentee: Gundlach

Issued: Mar. 14, 1978

U.S. Pat. No. 4,078,929 discloses the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to −900 volts, and exposed imagewise, such that one image corresponding to charged image areas (which are subsequently developed by charged-area development, i.e. CAD) stays at the full photoreceptor potential ($V_{cad}$ or $V_{ddp}$). $V_{ddp}$ is the voltage on the photoreceptor due to the loss of voltage while the photoreceptor remains charged in the absence of light, otherwise known as dark decay. Another image is exposed to discharge the photoreceptor to its residual potential, i.e. $V_{dad}$ or $V_c$ (typically −100 volts), which $V_c$ corresponds to discharged area images that are subsequently developed by discharged-area development (DAD). The background area is exposed so as to reduce the photoreceptor potential to halfway between the $V_{cad}$ and $V_{dad}$ potentials, (typically −500 volts) and is referred to as $V_{white}$. The CAD developer is typically biased about 100 volts closer to $V_{cad}$ than $V_{white}$ (about −600 volts), and the DAD developer system is biased about 100 volts closer to $V_{dad}$ than $V_{white}$ (about −400 volts). As will be appreciated, the highlight color need not be a different color but may have other distinguishing characteristics. For example, one toner may be magnetic and the other non-magnetic.

It is generally well known to control and adjust particular parameters of an electrophotographic printing machine. For example, individual control signals can be used to adjust operating elements of a printing machine, such as controlling development by control of the ratio of toner particles to carrier granules in the developer material and the electrical bias applied to the developer roller. Other control techniques compare a signal measuring the reflected light from a clean photoconductive member to a signal reflected from a developed test patch formed thereon. The resultant error signal regulates toner dispensing to control the concentration of toner particles in the developer material on the photoconductive surface. Generally, the density of the developer material developed on the test patch is monitored by an infrared densitometer. In various applications, the photoreceptive member includes at least two document zones and an interdocument zone disposed therebetween. Preferably, an image from a document is developed in the document zone while the test patch is developed in the interdocument zone. Typically, the test patch is formed in the interdocument zone so as not to interfere with imaging in the document zone. The following patents and applications pertain to arrangements for generating and monitoring toner density of developed test patches disposed in interdocument zones:

U.S. patent application Ser. No. 07/755,193

Applicants: Scheuer et al.

Filed: Sep. 5, 1991

U.S. patent application Ser. No. 07/755,197

Applicants: Berman et al.

Filed: Sep. 5, 1991

U.S. Pat. No. 4,999,673

Patentee: Bares

Issued: Mar. 12, 1991

U.S. Pat. No. 5,019,859

Patentee: Nash

Issued: May 28, 1991

The following patent is directed toward a cleaning arrangement for a highlight color printing system:

U.S. Pat. No. 5,175,590

Patentees: Frankel et al.

Issued: Dec. 29, 1993

U.S. Pat. No. 5,175,590 discloses an arrangement including a plurality of corona devices disposed about a photoreceptor. In one example, optimal transfer and detack of non-black and black developer materials from respective document zones appears to be obtained when the applied currents of the corona devices are set at preselected levels.

Recently, electrophotographic reproducing machines, such as the one described above, have been developed which use one or more replaceable subassembly units, familiarly termed cartridges. One typical cartridge comprises a toner supply and the necessary supporting hardware therefor assembled in a single unit designed for insertion and removal into and out of the machine. When the cartridge is used up, the old cartridge is removed and a new one substituted. Other replaceable cartridges including developer cartridges, photoreceptor cartridges, etc., may also be envisioned for this purpose.

The following patent, the pertinent portions of which are incorporated herein by reference, is directed toward an example of a cartridge, also referred to as a "customer replaceable unit" ("CRU").

U.S. Pat. No. 4,961,088
Patentees: Gilliland et al.
Issued: Feb. 1, 1994

U.S. Pat. No. 4,961,088 discloses a system for monitoring replaceable cartridges in printers or copiers. Each replaceable cartridge includes an EEPROM (Electrically Eraseable Programmable Read Only Memory). The EEPROM associated with each cartridge may be programmed with an identification number and means for retaining a count of prints or copies made with the unit. The EEPROM may also be designed to retain a cartridge replacement warning count and a termination count at which the cartridge is disabled from further use.

Other CRUs employing EEPROMs are disclosed in the following patents:

U.S. Pat. No. 5,272,503
Patentees: LeSueur et al.
Issued Dec. 21, 1993
U.S. Pat. No. 5,283,613
Patentee: Midgley, Sr.
Issued: Feb. 1, 1994

U.S. Pat. No. 5,272,503 discloses a system in which a printing machine operating parameter is adjusted, with a controller, in accordance with a value stored in CRU memory and updated in response to a predetermined period of subassembly usage.

It has been found that employing CRUs in a highlight color printing machine that uses many different color toners can be problematic. More particularly, as will appear from the description below, various setpoints are preferably set in a color printing machine to accommodate for a given toner type. These values corresponding to the various setpoints are stored in nonvolatile memory ("NVM"). When many colors are interchanged with the color printing machine, by way of different CRUs, a relatively large number of values, corresponding to the setpoints required for the different CRUs, must be stored in NVM. While this approach is acceptable for a printing machine with virtually unlimited NVM, it is unsuitable for those situations where memory usage must be economized.

The following reference anticipates such economization of memory for a paper cassette:

Bober, H. T.

*Intelligent Paper Cassette*

Xerox Disclosure Journal, Vol. 18, No. 5 at p. 519

September/October 1993

The above-disclosed intelligent paper cassette is adapted to adjust print machine setpoints in accordance with the type of paper being employed in the cassette. Essentially, the intelligent paper cassette permits a machine user to select optimum setpoints for a particular substrate type. This approach is very useful for adjusting certain machine setpoints which facilitate, among others, paper handling and imaging. A relatively complex printing machine, however, includes a wide variety of setpoints, many of which would not be accommodated by the intelligent paper cassette. Moreover, for certain processes, such as development, it is crucial that the setpoints be initialized and maintained within a given range. To achieve this end it may be necessary to adjust the setpoints dynamically. It would be desirable to provide a system which is capable of setting and maintaining a suite of setpoints in a manner which optimizes development in a printing system.

SUMMARY OF THE INVENTION

In accordance with the disclosed embodiment of the present invention there is provided an improved control system for a printing machine with a photoreceptor for developing an image with developer material and controllable printing machine components including respective setpoints for changing development of the photoreceptor with the developer material. The control system communicates with selected ones of the controllable printing machine components and detects an amount of developer material developed in a selected area of the photoreceptor with the detected amount of developer material being represented by a first value. The control system includes a replaceable cartridge, adapted for use with the printing machine. The replaceable cartridge includes a container for storing a selected developer material different from a developer material previously in the printing machine, and a programmable memory unit communicating with the control system and being programmed with a second value reflecting a desired amount of the selected developer material to be developed on the photoreceptor. In a preferred mode of operation, the control system reads the second value and determines if a difference exists between the first and second values. When a difference exists between the first value and the second value, and when the difference is greater than a selected magnitude, the setpoint of one of the controllable printing machine components is adjusted.

These and other aspects of the invention will become apparent from the following description, the description being used to illustrate a preferred embodiment of the invention when read in conjunction with the accompanying drawings.

DESCRIPTION OF PREFERRED EMBODIMENTS

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 7:
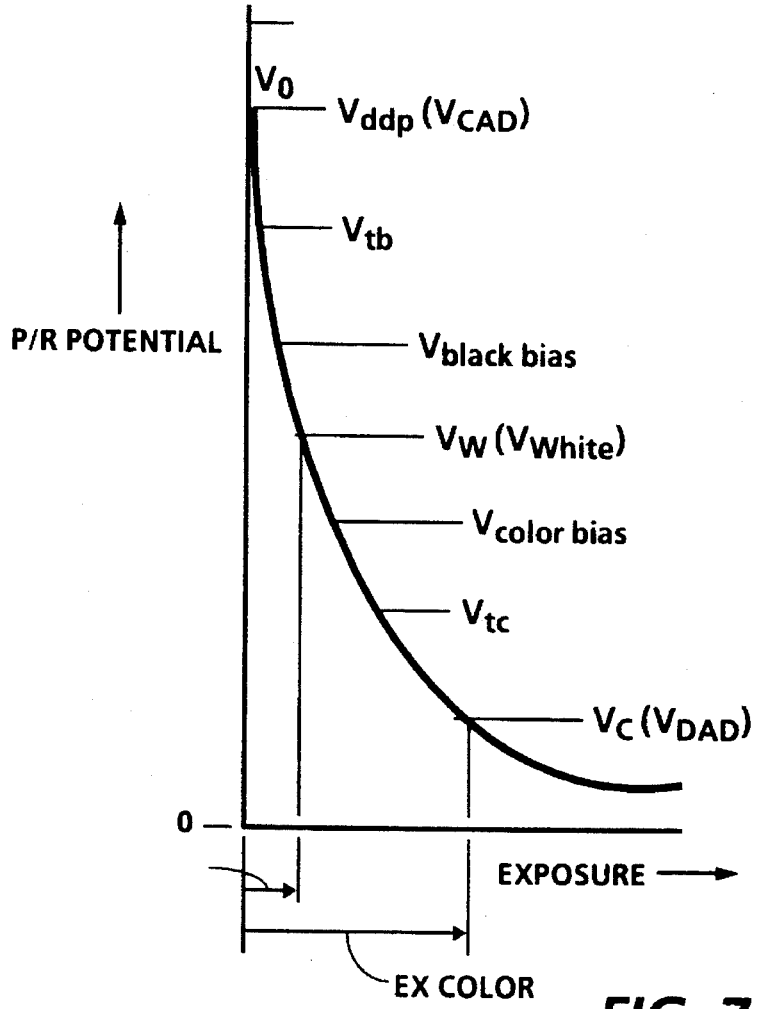
FIG. 7 (PRIOR ART)
FIG. 7 is a plot of photoreceptor potential versus exposure, for a tri-level electrostatic latent image.
Figure 8:
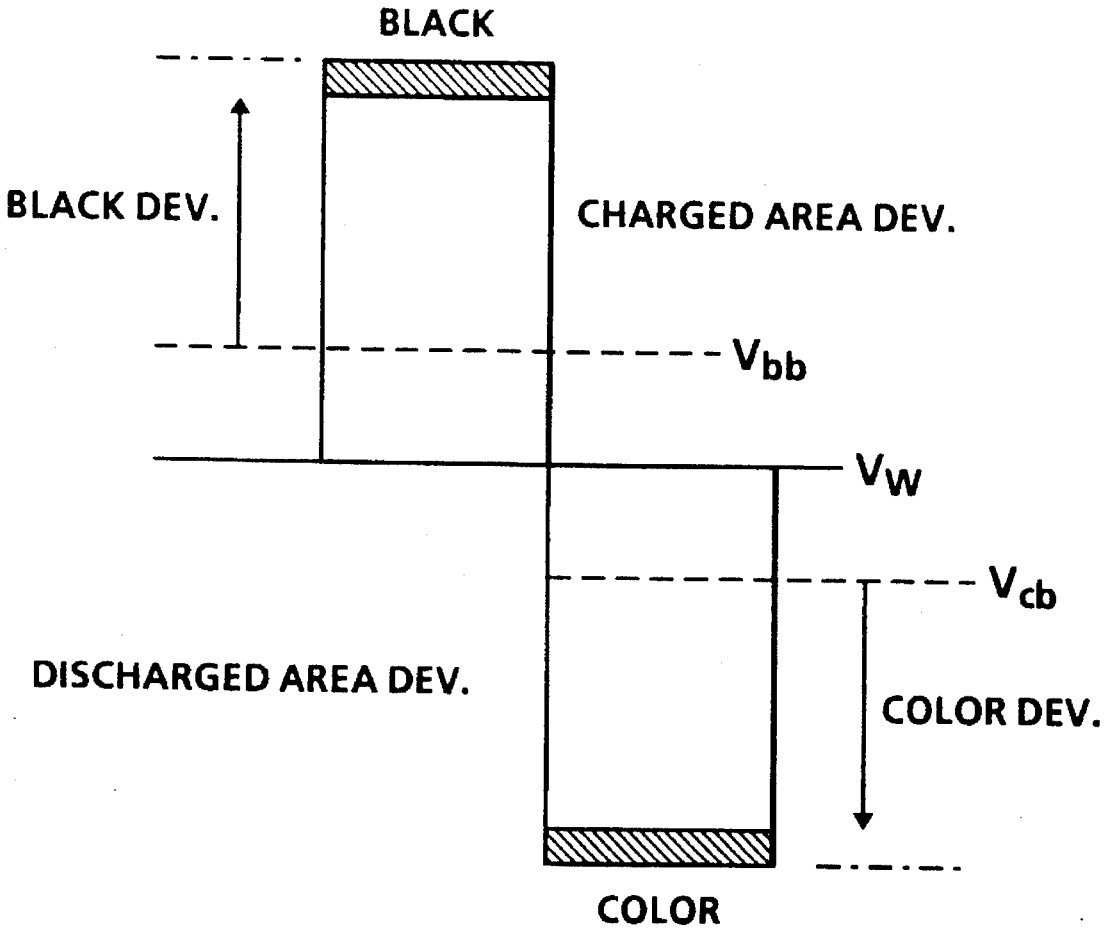
FIG. 8 (PRIOR ART)
FIG. 8 is a plot of photoreceptor potential representing particular single-pass, highlight color latent image characteristics.

Referring to FIGS. 7 and 8, the concept of tri-level highlight color imaging is described generally. For a photo-induced discharge curve ("PIDC") of FIG. 7, $V_0$ represents the initial charge level, $V_{ddp}$ ($V_{CAD}$) the dark discharge potential (unexposed), $V_{White}$, the white or background discharge level, and $V_c$ ($V_{DAD}$) the photoreceptor residual potential. In one example, nominal voltage magnitudes for $V_{CAD}$, $V_{White}$ and $V_{DAD}$ are 788 v, 423 v and 123 v, respectively.

In highlight color applications, color discrimination in the development of the electrostatic latent image is achieved by passing the photoreceptor, with a latent image disposed thereon, through first and second developer housings and biasing the housings to voltages which are offset from the background voltage $V_{White}$. In one illustrated embodiment, the second housing contains developer with positively charged black toner. Accordingly, the toner from the second housing is driven to the most highly charged ($V_{ddp}$) areas of the latent image by the electrostatic field between the photoreceptor and the development rolls in the second housing, the second housing development rolls being biased at $V_{black\ bias}$ ($V_{bb}$). The first housing contains negatively charged colored toner. Accordingly, the toner from the first housing is urged towards parts of the latent image at the residual potential, namely $V_{DAD}$, by the electrostatic field existing between the photoreceptor and the development rolls of the first housing, the first housing rolls being biased to $V_{color\ bias}$, ($V_{cb}$). In one example, nominal voltage magnitudes for $V_{bb}$ and $V_{cb}$ are 641 v and 294 v, respectively.

Figure 1:
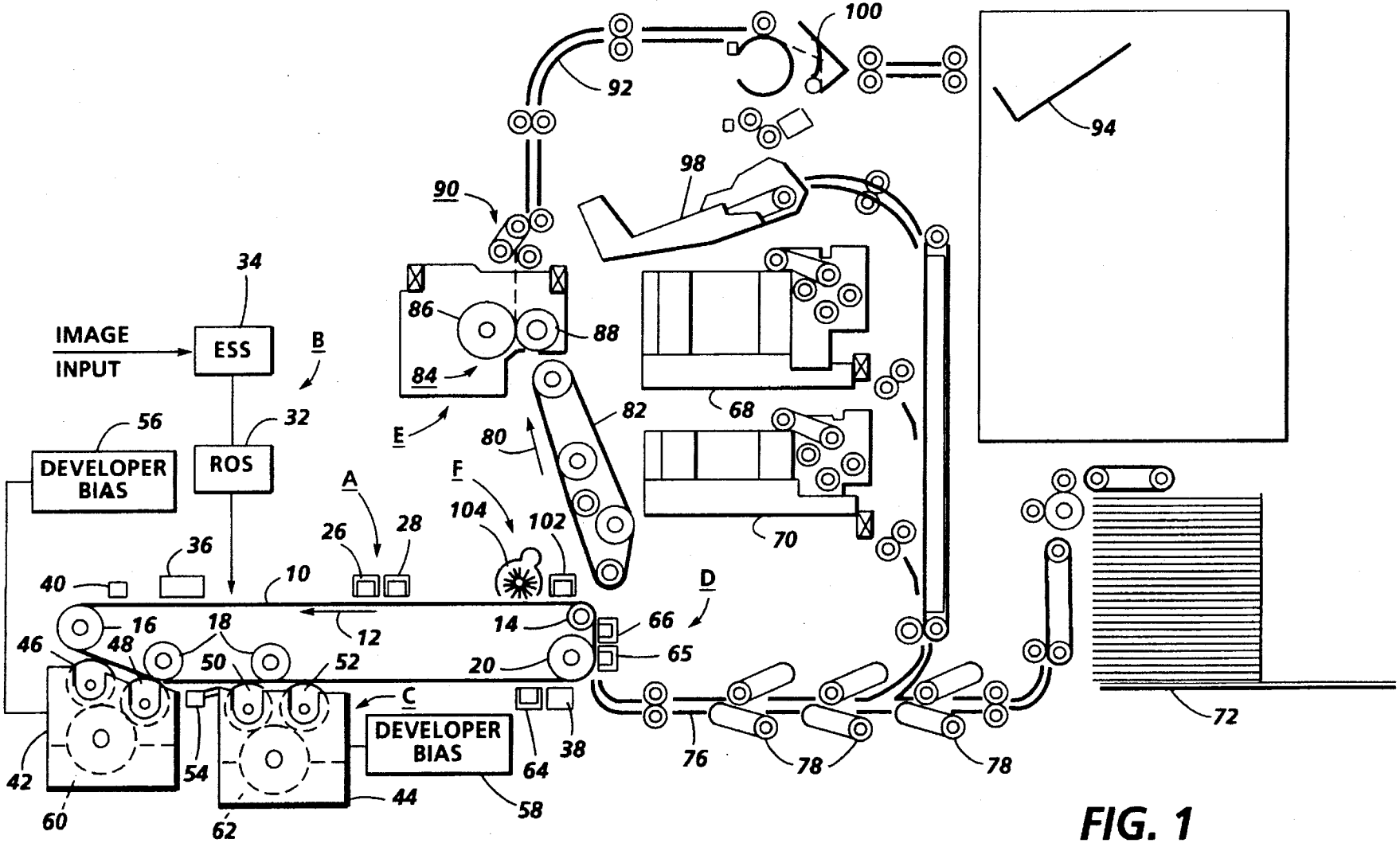
FIG. 1 is a schematic, elevational view of a printing machine.

Referring to FIG. 1, a reproduction machine in which the present invention finds advantageous use employs a photoreceptor belt 10 having a charge retentive surface. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive. Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

Figure 2:
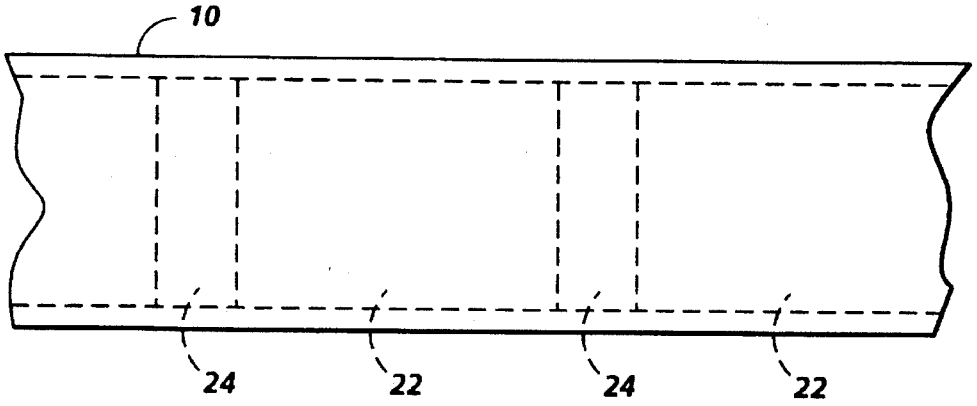
FIG. 2 is a partial, plan view of a photoreceptive belt used in the printing machine of FIG. 1.

Referring to FIG. 2, in the preferred embodiment of the present invention, latent images from documents are formed respectively in document portions or zones of the charge retentive surface of the photoreceptor, each of which document zones is designated by the numeral 22. Areas interposed between the document zones 22, are referred to as interdocument zones, and are designated by the numeral 24.

Referring again to FIG. 1, portions of the belt 10 pass through charging station A. At charging station A, a pair of corona devices 26 and 28 charge successive portions 22, 24 of the photoreceptor belt 10 to a relatively high, substantially uniform negative potential.

At exposure station B, the uniformly charged photoreceptor is exposed to a laser based scanning device 32 or ROS, which, in accordance with a driving ESS 34, discharges the photoreceptor to one of three charge levels in accordance with a stored image. This records an electrostatic latent image on the belt which corresponds to the informational area contained within electronically stored original information. The ROS could be replaced with a conventional electrophotographic exposure arrangement.

In the preferred mode of operation, the charge retentive surface of the belt 10, which is initially charged to a voltage $V_0$, undergoes dark decay to a level $V_{ddp}$ or $V_{CAD}$ equal to about −900 volts to form CAD images. Upon being exposed at the exposure station B, the photoreceptor is discharged to $V_c$ or $V_{DAD}$ equal to about −100 v to form a DAD image which is about zero or ground potential in the highlight color parts of the image. During exposure, the charge retentive surface of the belt 10 is also discharged to $V_{White}$, the magnitude of $V_{White}$ equaling approximately − 500 v in the background (white) areas.

Referring still to FIG. 1, a patch generator is designated by the numeral 36. In one example, the generator 36 comprises a conventional exposure device, and serves to record test or control patches in the interdocument zones 24, the test patches being used both in a developed and undeveloped condition for controlling various process functions. An Infra-Red densitometer (IRD) 38 is utilized to sense or measure the reflectance of test patches after they have been developed. It should be recognized that each test patch can be recorded and developed with multiple toners having differing polarities. Thus, the patch generator 36 is preferably adapted to provide different levels of exposure for any one given interdocument zone 24. A first electrostatic voltmeter ($ESV_1$) 40 is positioned downstream of the patch generator 36 for monitoring certain electrostatic charge levels (i.e. $V_{DAD}$, $V_{CAD}$, $V_{White}$, and $V_{tc}$) on various portions of the photoreceptive belt 10.

At development station C, a magnetic brush development system advances developer materials into contact with an electrostatic latent images on the photoreceptor. The development station C comprises a first developer housing 42 and second developer housing 44. Preferably, the housing 42 contains a pair of magnetic brush developer rollers 46, 48 while the housing 44 contains a pair of magnetic brush developer rollers 50, 52. Each pair of rollers advances its respective developer material into contact with the latent image. Appropriate developer biasing is accomplished via power supplies 56 and 58, the power supplies 56, 58 being electrically coupled with respective developer housings 42, 44. A pair of toner replenishment devices (not shown) are provided for replacing the toner as it is depleted from the developer housing structures 42, 44.

Color discrimination in the development of the electrostatic latent image is achieved by passing the photoreceptor past the two developer housings 42 and 44 in a single pass with the magnetic brush rolls 46, 48, 50 and 52 electrically biased to voltages which are offset from the background voltage $V_{White}$ in a direction depending on the polarity of toner in the housing. In the illustrated embodiment of FIG.

1, the housing 42 contains negatively charged blue conductive magnetic brush (CMB) developer 60. Accordingly, the blue toner is driven to the least highly charged areas at the potential $V_{DAD}$ of the latent images by the electrostatic development field ($V_{DAD-Vcolor\ bias}$) between the photoreceptor and the development rolls 46, 48. On the other hand, the housing 44 contains positively charged black toner 62. Accordingly, the black toner is urged towards the parts of the latent images at the most highly charged potential $V_{CAD}$ by the electrostatic development field ($V_{CAD}-V_{black\ bias}$) existing between the photoreceptor and the development rolls 50, 52. A second electrostatic voltmeter ($ESV_2$) 54 is positioned downstream of the first developer housing 42 for monitoring certain electrostatic charge levels (i.e. $V_{DAD}$, $V_{CAD}$, $V_{White}$, $V_{ib}$ and $V_{ic}$) on various portions of the photoreceptive belt 10.

Preferably, the rollers 46 and 48 are biased using a chopped DC bias via power supply 56, while the rollers 50 and 52 are biased using a chopped DC bias via power supply 58. The expression chopped DC ("CDC") bias refers to the process of alternating a developer housing between two potentials, namely a first potential roughly representing the normal bias for the DAD developer, and a second potential roughly representing a bias that is considerably more negative than the normal bias. The first potential is identified as $V_{Bias\ Low}$ while the second potential as $V_{Bias\ High}$. Further details regarding CDC biasing are provided in U.S. patent application Ser. No. 440,913, the pertinent portions of which are incorporated herein by reference.

Because the composite image developed on the photoreceptor consists of both positive and negative toner, a negative pretransfer dicorotron 64 is employed to condition the toner for effective transfer to a substrate using positive corona discharge. As will be appreciated from the discussion below, the concept of the invention would not be altered by conditioning the toner for transfer with negative corona discharge. Subsequent to providing pretransfer, belt 10 advances the developed latent image to transfer station D. At transfer station D, a sheet of support material such as a paper copy sheet is moved into contact with the developed latent images on belt 10 and a corona generating device 65 charges the copy sheet to the proper potential so that it is tacked to photoreceptor belt 10 and the toner powder image is attracted from photoreceptor belt 10 to the sheet. As will be appreciated by those skilled in the art, the generating device 65 could be replaced by, or used in conjunction with, one of many known transfer devices, such a bias transfer roll of the type used in a Xerox 9700 printer (the term "Xerox" is a registered trademark of the Xerox Corporation), an acoustical transfer assist device of the type disclosed in U.S. Pat. No. 5,081,500 to Snelling and an electrostatic transport device of the type used in a Konica 9028 printing apparatus, without altering the concept of the present invention. After transfer, a corona generator 66 charges the copy sheet with an opposite polarity to detack the copy sheet for belt 10, whereupon the sheet is stripped from belt 10 at stripping roller 14. For each interdocument zone 24 (FIG. 2), charge from the corona generators 65–66 is applied to each zone 24 as it is passed by the generators 65–66.

Sheets of support material are advanced to transfer station D from supply trays 68, 70 and 72, which supply trays may hold different quantities, sizes and types of support materials. Sheets are advanced to transfer station D along conveyor 76 and rollers 78. After transfer, the sheet continues to move in the direction of arrow 80 onto a conveyor 82 which advances the sheet to fusing station E.

Fusing station E, which includes a fuser assembly, indicated generally by the reference numeral 84, serves to permanently affix the transferred toner powder images to the sheets. Preferably, fuser assembly 84 includes a heated fuser roller 86 adapted to be pressure engaged with a back-up roller 88 with the toner powder images contacting fuser roller 86. In this manner, the toner powder image is permanently affixed to the sheet.

After fusing, copy sheets bearing fused images are directed through decurler 90. Chute 92 guides the advancing sheet from decurler 90 to catch tray 94 or a finishing station for binding, stapling, collating etc. and removal from the machine by the operator. Alternatively, the sheet may be advanced to a duplex tray 98 from duplex gate 100 from which it will be returned to the processor and conveyor 76 for receiving second side copy.

A pre-clean corona generating device 102 is provided for exposing the residual toner and contaminants (hereinafter, collectively referred to as toner) to positive charges to thereby shift the charge distribution thereon in a positive direction for more effective removal at cleaning station F. The cleaning station F further includes an electrically insulative, rotatably mounted cleaning member designated by the numeral 104. In the preferred embodiment, the member 104 is a fibrous brush in contact with the surface of the belt 10. The insulative brush is capable of being charged up during rotation, via triboelectric interaction with other cleaning members, for attracting toner(s) of the opposite polarity. Alternatively, the brush could be a conductive brush adapted to be biased for attracting toner(s) of the opposite polarity. A conductive brush suited for such cleaning is disclosed in U.S. Pat. No. 4,819,026 to Lange et al., the pertinent portions of which are incorporated by reference. In another example, two brushes could be mounted in cleaning relationship relative to the surface of the belt 10 to achieve redundancy in cleaning. It is contemplated that residual toner remaining on charge retentive surface of belt 10 after transfer will be reclaimed and returned to the developer station C by any one of several well known reclaim arrangements.

Figure 3:
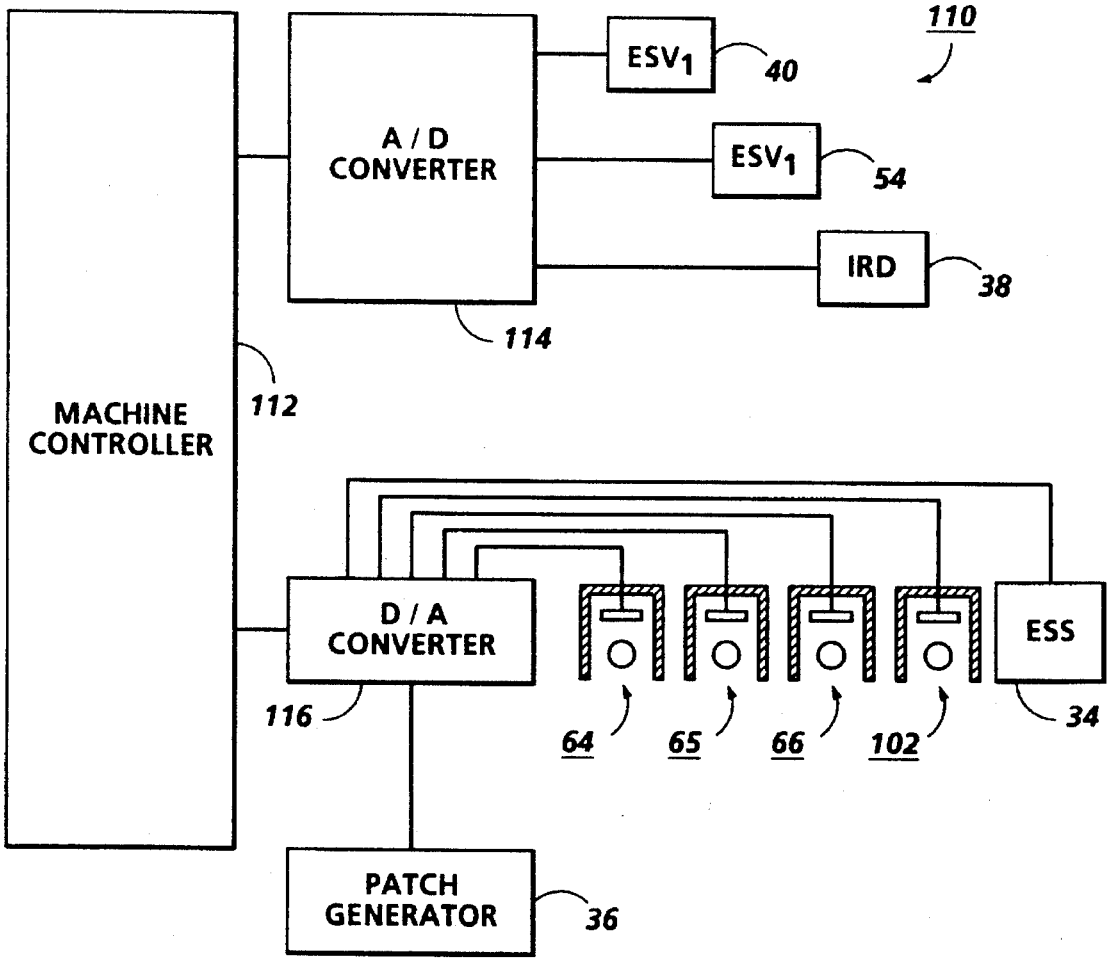
FIG. 3 is a schematic view of a control circuit used to control various components of the printing machine of FIG. 2.

Referring to FIG. 3, a control circuit for use with the above-described xerographic engine is designated with the numeral 110. In the illustrated embodiment of FIG. 3, the IRD 38, ESV1 40 and ESV2 54 are coupled with a machine controller 112 by way of an A/D converter 114, while the ESS 34, the patch generator 36 and the corona devices 64–66 and 102 are coupled with the controller 112 by way of a D/A converter 116. As will be appreciated by those skilled in the art, the machine controller 112 includes all of the appropriate circuitry for controlling the various devices coupled therewith and suitable memory for storing reference values corresponding to any measurements received from the ESV1, ESV2 or the IRD. In one embodiment, the machine controller 112 could comprise a virtual machine control apparatus of the type disclosed in U.S. Pat. No. 4,475,156 to Federico et al.

Figure 4:
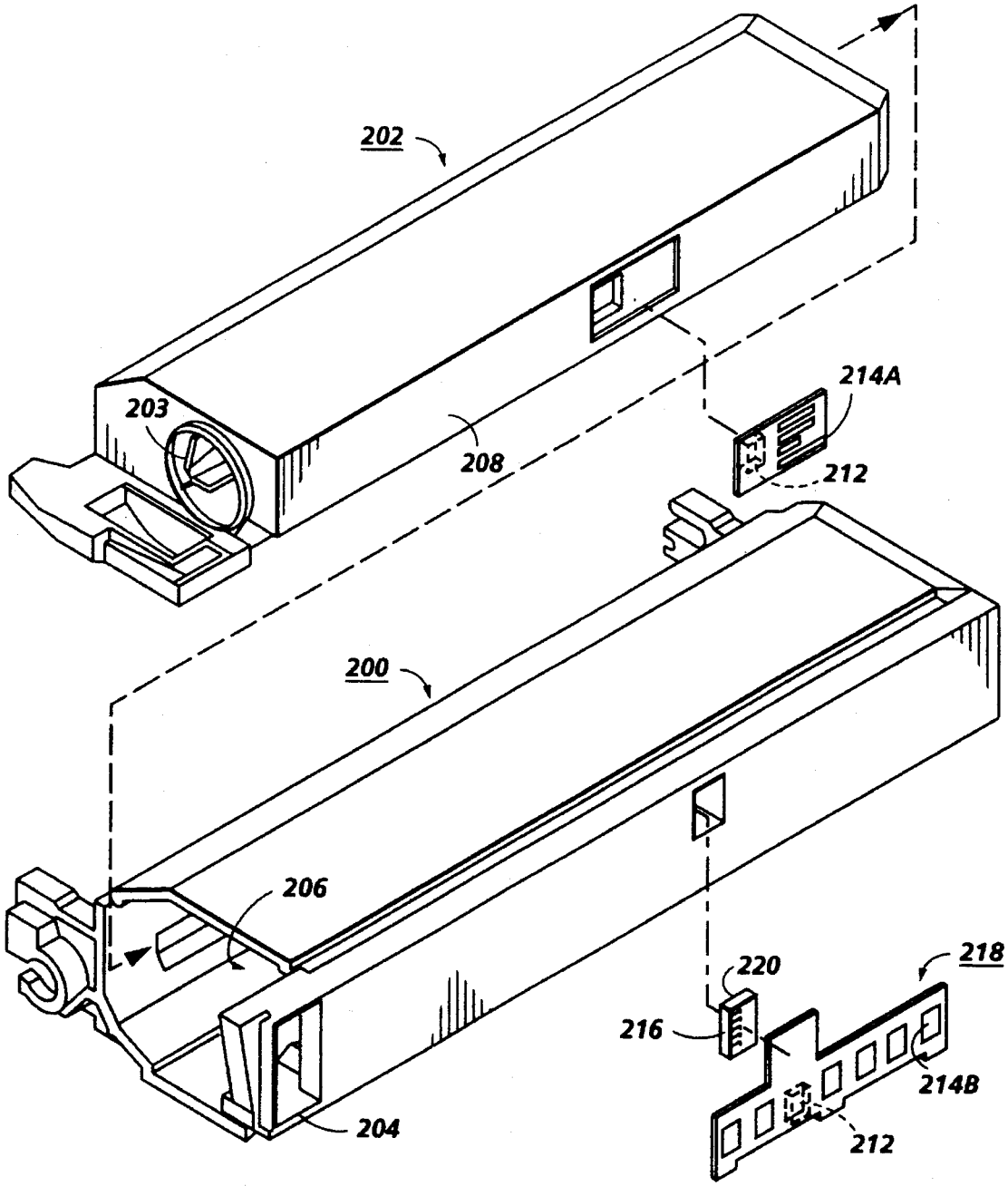
FIG. 4 is a perspective view showing details of replaceable developer and toner cartridges for the machine of FIG. 1.

Referring to FIG. 4, in one contemplated embodiment the developer housing structures 42, 44 are implemented with an arrangement of the type disclosed in U.S. Pat. No. 4,961,088 to Gilliland et al. and include a developer cartridge 200 and a toner cartridge 202. Since the structure of each housing structure is the same, only the structure for the developer housing structure 42 is discussed. As seen in FIG. 4, a body 204 of developer cartridge 200 forms a cavity 206 for receipt of toner cartridge 202, cavity 206 of cartridge 200 and body 208 of cartridge 202 having complementary shapes and dimensions such that on insertion of cartridge 202 into cavity 206, cartridge 202 is in predetermined operating relation with magnetic brush rolls 46, 48 in developer cartridge 200. With insertion of toner cartridge 202, auger 203 is drivingly coupled to the developer driving means (not shown) and the electrical connections to cartridge 202 made.

In the illustrated embodiment of FIG. 4, each cartridge includes a memory 212 in the form of a chip integral therewith. Preferably, each chip comprises EEPROM. To enable memory 212 to be electrically connected and disconnected with the machine on installation or removal of the cartridges, contact pads 214A or 214B are provided. Terminal blocks 216 and a terminal board 218 are employed to complete the electrical connection between memory 212 and the machine control unit 112 of FIG. 3. As seen in FIG. 4, the terminal block 216 for toner cartridge 202 is mounted on terminal board 218. The EEPROM 212 for developer cartridge 200 is also mounted on board 218. Contact pads 214B on board 218 serve to electrically couple the memory 212 of developer cartridge 200 and, through the intermediary of terminal block 216, the memory 212 of toner cartridge 202 to the machine control unit. On installation of toner cartridge 202 into the printing system, contact pads 214A of the toner cartridge memory 202 engage contacts 220 of the terminal block 216 for toner cartridge 202 on board 218. On installation of the developer cartridge 200 into the printing system, contacts 214B for both the memory 212 of toner cartridge 202 and the memory 212 of developer cartridge 200 mate to a second set of contacts mounted on the machine frame (not shown) to complete the electrical connection.

Another CRU with on-board EEPROM is disclosed in U.S. Pat. No. 5,272,503, the pertinent portions of which are incorporated herein by reference.

Figure 5:
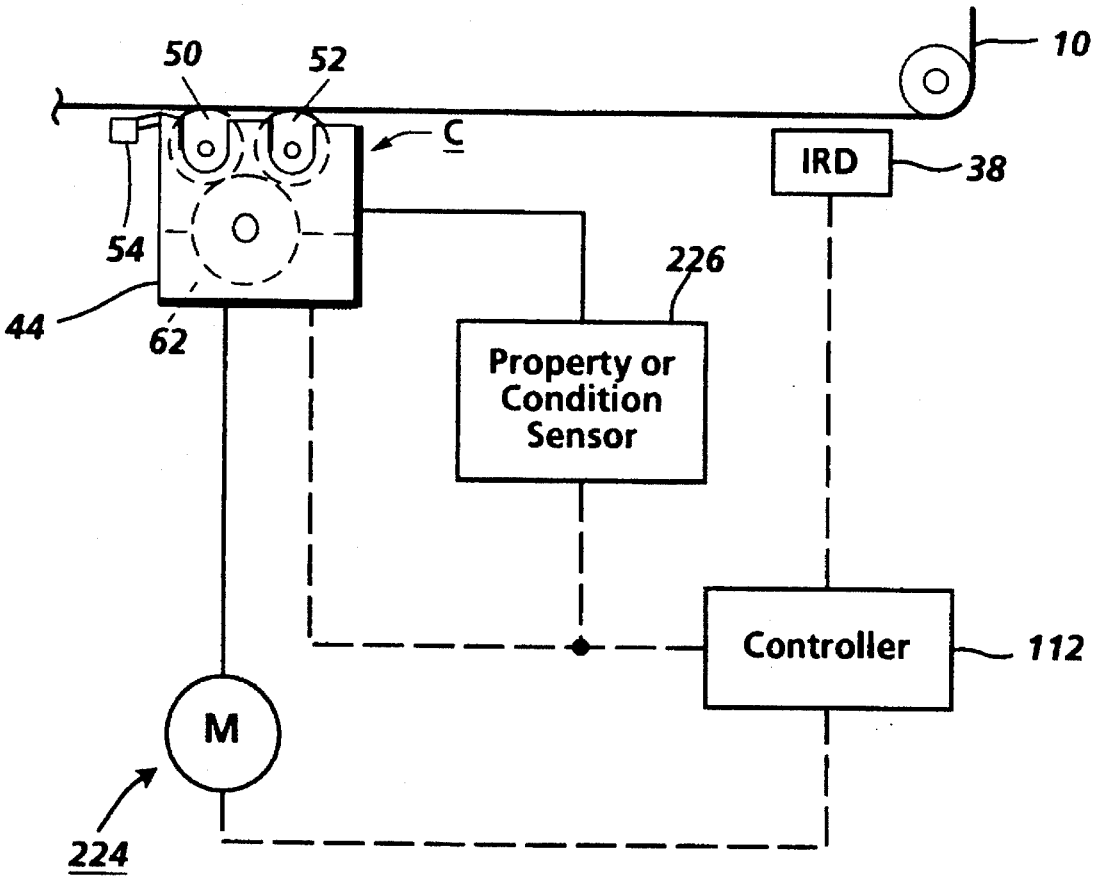
FIG. 5 is a schematic, elevational view of a portion of the printing machine of FIG. 1.

It has been found that a CRU, such as the toner cartridge 202 can be used to facilitate toner dispensing and/or adjustment of particular machine setpoints, the particular machine setpoints being related, preferably, to the development process. Referring to FIG. 5, the use of the toner cartridge to facilitate toner dispensing is discussed. As indicated by FIG. 5, the respective augurs of the developer housing structures 42, 44 are driven by a motor 224. The torque of the motor is controlled by the machine controller 112. In the preferred embodiment, the motor comprises an adjustable cycle frequency motor, i.e. a motor that is cycled up and down, when necessary, to dispense a desired amount of toner. Additionally, a property or condition of the toner is sensed through use of a suitable sensor 226, such as a sensor Sensing conductivity, humidity level or dispensing rate or flow. Sensing of development related parameters can be fully comprehended by reference to U.S. Pat. Nos. 4,937,157, 4,937,166, 5,114,821 and 5,196,803, the pertinent portions of which patents are incorporated herein by reference. The sensor 226 can be disposed in the structures 42, 44 or operatively associated therewith. A "pixel counting" sensor which communicates with the structures is disclosed in U.S. Pat. No. 5,204,698 to LeSueur et al. the pertinent portions of which are incorporated herein by reference.

In a highlight color printing machine, of the type disclosed in FIG. 1, developer housing structures are interchanged, relative to the printing machine, in order to obtain different highlight colors. As the structures, with their respective contents, age the ability to dispense developer material degrades. This degradation in dispensing capability can be detected by comparing a reference value with a sensed value obtained from the sensor 226. In one mode of operation, the reference value is stored in the memory of the cartridge 202. In turn, the controller 112 queries the cartridge memory to obtain the reference value and compares the reference value with either a sensed value obtained from the motor 224 or the sensor 226. If the difference is beyond a preset tolerance then the cycle time of the motor is adjusted until the difference is within an acceptable tolerance.

In one example, the error between an observed patch target and a reference patch target is two bits. For the case in which the cartridge 202 includes a powerful toner dispenser, toner concentration could be corrected by running the motor for 200 msec. Accordingly, the best feedback to the motor, from the controller 112 (FIG. 3), would be 100 msec/bit. On the other hand, for the case in which the toner dispenser is relatively weak, a comparable toner correction might be achieved by running the motor for 400 msec. Accordingly a feedback multiplier of 200 msec/error bit would be required.

It has been further found that the toner cartridge, in conjunction with the machine controller 112, can be used to facilitate adjustment of certain machine setpoints that are particularly pertinent to a development process. An understanding of such pertinent setpoints can be more fully comprehended by reference to U.S. Pat. No. 5,175,590 to Frankel et al. or U.S. Pat. No. 5,223,897 to MacDonald et al., the pertinent portions of which are incorporated herein by reference. In the preferred embodiment, optimal values for certain parameters, such as color development bias, photoreceptor bias, black developer bias, respective voltages for black white and color areas on the photoreceptor, pretransfer/transfer/preclean currents, cleaner bias, color development field and patch development field are programmed initially in the memory of the toner cartridge 202 for use by the machine controller 112 in adjusting various machine setpoints.

Figure 6:
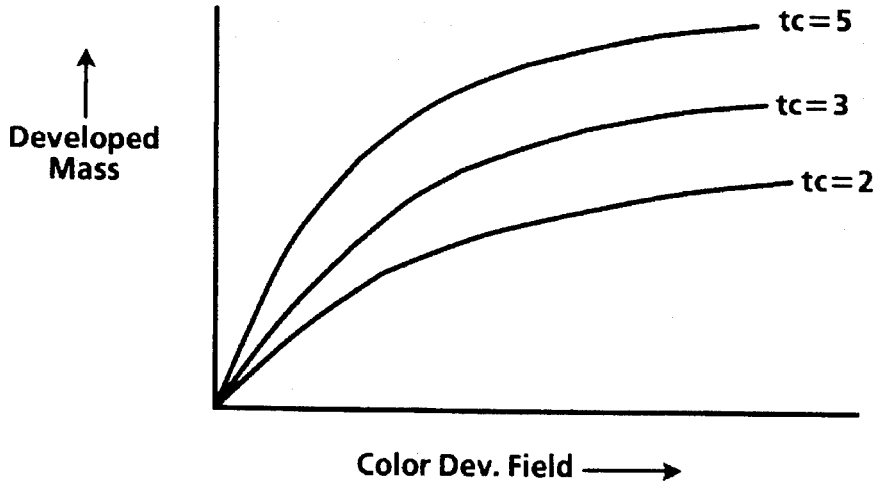
FIG. 6 is a plot demonstrating a relationship between developed mass, toner concentration and color development field.

It will be appreciated that, as a result of the programming, selected relationships exist between certain ones of the parameters. Referring to FIG. 6, for example, a relationship exists between toner concentration, which varies as a function of patch development field, and color development field. Initially, the relationship between these two parameters will be set so that a desired value for developed mass per unit photoreceptor area ("DMA") is obtained. During machine operation, toner concentration in the cartridge 202 decreases as developer material is applied to the photoreceptor. This depletion can be ascertained with the sensor 226. A drop in developed mass (FIG. 6) occurs, as a result of such depletion unless patch development field and/or color development field is increased to compensate for such depletion.

A need for compensation can be perceived with one of several indicators. In one example, a drop in toner concentration in the cartridge 202 is sensed with the sensor 226 and thereby detected with the controller 112. Upon detecting the drop in toner concentration, the controller reads the stored values for color development field and patch development field, from the memory 212 of the cartridge 202, and compares the same to, respective currently detected setpoints. Setpoints can be detected with control circuitry, such as that shown in FIG. 3. Further discussion of control circuitry employed to detect setpoints is disclosed in U.S. Pat. Nos. 5,175,590 and 5,223,897. When the resulting difference varies from a preset tolerance, the controller decides, based on a preselected program, whether to compensate for the toner concentration depletion by changing the related voltage for color development field and/or the related voltage for patch development field. Preferably, any changes in one or both of the related voltages are written to the memory 212 for reference in any future compensation.

It should be appreciated that the values in the memory 2 12 can be reprogrammed at any time to accommodate for user preferences in development. In one example, patch development field can be adjusted, in one direction or another, to enhance solid area coverage or text quality. In another example, a tradeoff between solid area coverage and halftoning is achieved by adjusting pre-transfer current. More particularly, pre-transfer current can be increased to enhance black solid area coverage or decreased to enhance a form of halftoning known as "tint".

Numerous features of the disclosed embodiment will be appreciated by those skilled in the art. First, the disclosed system, uses the memory of a customer replaceable unit ("CRU"), in conjunction with both a machine controller and a motor, to accommodate for changes in a dispensing capability of the CRU. In particular, a value, representing the desired dispensation rate of the CRU and being stored in the memory of the CRU, is compared with a value representing the actual dispensation rate of the CRU. If the difference between the two values exceeds a preset tolerance, then the motor is adjusted to correspond with the desired dispensation rate.

Second, the disclosed system permits other machine setpoints to be adjusted on the basis of stored values in the CRU. For example, as a drop in toner concentration is detected by the controller, the controller compares stored values, such as patch development and color development field to detected setpoints. When the difference is beyond a tolerable range, one or both of the setpoints is adjusted to obtain a preset level for developed mass per unit area. In turn, one or both of the stored values is reprogrammed with the controller to reflect the adjusted setpoints.

Finally, the stored values in the CRU can be reprogrammed at any time to reflect user preference in development. For example, solid area coverage or text quality can be enhanced by adjusting patch development field while black solid area or tint can be enhanced by adjusting pre-transfer current.

What is claimed is:

1. In a printing machine with a photoreceptor for developing an image with developer material including plural properties, controllable printing machine components including respective setpoints for changing development of the photoreceptor with the developer material, and a control system communicating with selected ones of the controllable printing machine components, the control system including an apparatus for measuring one of the plural properties and the control system detecting an amount of developer material developed in a selected area of the photoreceptor with the detected amount of developer material being represented by a first value, an improved said control system comprising:

a replaceable cartridge, adapted for use with the printing machine, including, a container for storing a selected developer material different from a developer material previously in the printing machine, and a programmable memory unit communicating with the control system and being programmed with a second value reflecting a desired amount of the selected developer material to be developed on the photoreceptor, said control system reading the second value and determining if a difference exists between the first and second values;

when a difference exists between the first value and the second value, and when the difference is greater than a selected magnitude, adjusting the setpoint of one of the controllable printing machine components; and wherein said control system includes a controller, said controller adiusting a magnitude of the second value to accommodate for a change in one of the plural properties.

2. The control system of claim 1, wherein said control system includes a sensing apparatus for sensing the amount of developer material developed in the selected area and a controller communicating with both said sensing apparatus and said replaceable cartridge, said controller generating the first value from sensed information communicated from said sensing apparatus.

3. The control system of claim 2, wherein said sensing apparatus includes a sensor, disposed adjacent the photoreceptor, for sensing the amount of developer material developed in the selected area.

4. The control system of claim 1, wherein one of the plural properties includes conductivity.

5. The control system of claim 1, wherein said programmable memory unit comprises electrically erasable programmable read only memory.

6. The control system of claim 1, in which the selected developer material is dispensed from said container at a dispensing rate and the dispensing rate is maintained with a motor including an operating parameter, wherein said adjusting of the setpoint includes adjusting the operating parameter.

7. The control system of claim 1, in which the photoreceptor includes a color development field and the detected amount of developer material includes a patch development field, wherein the setpoint varies as a function of one of the color development field and the patch development field.

8. The control system of claim 7, in which the difference is greater than the selected magnitude and the setpoint of a second one of the controllable printing machine components is adjusted, wherein both of the setpoints vary respectively as a function of the color development field and the patch development field.

9. In a printing machine with a photoreceptor for developing an image with developer material, controllable printing machine components including respective setpoints for changing development of the photoreceptor with the developer material, and a control system communicating with selected ones of the controllable printing machine components, the control system detecting an amount of developer material developed in a selected area of the photoreceptor with the detected amount of developer material being represented by a first value, an improved said control system comprising:

a replaceable cartridge, adapted for use with the printing machine, including, a container for storing a selected developer material different from a developer material previously in the printing machine, and a programmable memory: unit communicating with the control system and being programmed with a second value reflecting a desired amount of the selected developer material to be developed on the photoreceptor, said control system reading the second value and determining if a difference exists between the first and second values;

when a difference exists between the first value and the second value, and when the difference is greater than a selected magnitude, adjusting the setpoint of one of the controllable printing machine components; and a cleaning apparatus for removing portions of the selected developer material from the photoreceptor, said cleaning apparatus including a cleaning bias, wherein said adjusting of the setpoint includes adjusting the cleaning bias.

10. A replaceable cartridge for a printing machine, the printing machine including a photoreceptor for developing an image with developer material including plural properties, controllable printing machine components including respective setpoints for changing development of the photoreceptor with the developer material, and a control system communicating with selected ones of the controllable printing machine components, the control system detecting an amount of developer material developed in a selected area of the photoreceptor with the detected amount of developer material being represented by a first value, said replaceable cartridge comprising:

a container for storing a selected developer material different from a developer material previously in the printing machine, and a programmable memory unit communicating with the control system and being programmed with a second value reflecting a desired amount of the selected developer material to be developed on the photoreceptor, said control system reading the second value and determining if a difference exists between the first and second values;

when a difference exists between the first value and the second value, and when the difference is greater than a selected magnitude, adjusting the setpoint of one of the controllable printing machine components;

an apparatus for measuring one of the plural properties; and the control system includes a controller, said controller adjusting a magnitude of the second value to accommodate for a change in one of the plural properties.

11. The control system of claim 10, wherein said programmable memory unit comprises electrically programmably read only memory.

12. The control system of claim 10, in which the selected developer material is dispensed from said container at a dispensing rate and the dispensing rate is maintained with a motor including an operating parameter, wherein said adjusting of the setpoint includes adjusting the operating parameter.

13. The control system of claim 10, in which the photoreceptor includes a color development field and the detected amount of developer material includes a patch development field, wherein the setpoint varies as a function of one of the color development field and the patch development field.

14. The control system of claim 13, in which the difference is greater than the selected magnitude and the setpoint of a second one of the controllable printing machine components is adjusted, wherein both of the setpoints vary respectively as a function of the color development field and the patch development field.

15. The replaceable cartridge of claim 10, wherein one of the first and second values corresponds with a transfer current, the transfer current corresponding to an optimal relationship between black solid area coverage and halftoning for a particular developer material in the replaceable cartridge.

16. A replaceable cartridge for a printing machine, the printing machine including a photoreceptor for developing an image with developer material, controllable printing machine components including respective setpoints for changing development of the photoreceptor with the developer material, and a control system communicating with selected ones of the controllable printing machine components, the control system detecting an amount of developer material developed in a selected area of the photoreceptor with the detected amount of developer material being represented by a first value, said replaceable cartridge comprising:

a container for storing a selected developer material different from a developer material previously in the printing machine, and a programmable memory unit communicating with the control system and being programmed with a second value reflecting a desired amount of the selected developer material to be developed on the photoreceptor, said control system reading the second value and determining if a difference exists between the first and second values;

when a difference exists between the first value and the second value, and when the difference is greater than a selected magnitude, adjusting the setpoint of one of the controllable printing machine components; and a cleaning apparatus for removing portions of the selected developer material from the photoreceptor, said cleaning apparatus including a cleaning bias, wherein said adjusting of the setpoint includes adjusting the cleaning bias.

17. A method of controlling a degree to which developer material, with plural properties, is developed on a photoreceptor of a printing machine, the printing machine further including controllable printing machine components including respective setpoints for changing development of the photoreceptor with the developer material, a control system communicating with selected ones of the controllable printing machine components, and a replaceable cartridge adapted for use with the printing machine, the replaceable cartridge including a container for storing a selected developer material different from a developer material previously in the printing machine and a programmable memory unit communicating with the control system comprising the steps of:

detecting an amount of developer material developed in a selected area of the photoreceptor with the detected amount of developer material being represented by a first value;

the programmable memory unit including a second value reflecting a desired amount of the selected developer material to be developed on the photoreceptor;

reading the second value, with the control system and determining if a difference exists between the first and second values;

when a difference exists between the first value and the second value, and when the difference is greater than a selected magnitude, adjusting the setpoint of one of the controllable printing machine components;

measuring one of the plural properties; and adjusting a magnitude of the second value to accommodate for a change in one of the plural properties.

18. The method of claim 17, wherein said detecting step includes sensing the amount of developer material developed in the selected area of the photoreceptor and generating the first value from sensed information obtained with said sensing step.

19. The method of claim 17, in which the selected developer material is dispensed from said container at a dispensing rate and the dispensing rate is maintained with a motor including an operating parameter, further comprising the step of adjusting the operating parameter when it is determined, with said determining step, that a difference exceeding the selected magnitude exists.

20. The method of claim 17, in which the photoreceptor includes a color development field and the detected amount of developer material includes a developer portion development field, further including the step of adjusting one of the color development field and the developer portion development field when it is determined, with said determining step, that a difference exceeding the selected magnitude exists.

21. The method of claim 20, further comprising the step of obtaining a selected relationship between the color development field and the developer portion development field.

22. A method of controlling a degree to which developer material is developed on a photoreceptor of a printing machine, the printing machine including controllable printing machine components with respective setpoints for changing development of the photoreceptor with the developer material, a control system communicating with selected ones of the controllable printing machine components, and a replaceable cartridge adapted for use with the printing machine, the replaceable cartridge including a container for storing a selected developer material different from a developer material previously in the printing machine and a programmable memory unit communicating with the control system, wherein portions of the selected developer material are removed from the photoreceptor with a cleaning apparatus and the cleaning apparatus includes a cleaning bias, comprising the steps of:

detecting an amount of developer material developed in a selected area of the photoreceptor with the detected amount of developer material being represented by a first value;

the programmable memory unit including a second value reflecting a desired amount of the selected developer material to be developed on the photoreceptor;

reading the second value, with the control system and determining if a difference exists between the first and second values;

when a difference exists between the first value and the second value, and when the difference is greater than a selected magnitude, adjusting the setpoint of one of the controllable printing machine components; and adjusting the cleaning bias when it is determined, with said determining step, that a difference exceeding the selected magnitude exists.

23. In a printing machine with a photoreceptor for developing an image with developer material, controllable printing machine components including respective setpoints for changing development of the photoreceptor with the developer material, and a control system communicating with selected ones of the controllable printing machine components, the control system detecting an amount of developer material developed in a selected area of the photoreceptor with the detected amount of developer material being represented by a patch value, an improved said control system comprising:

(a) a first replaceable cartridge, adapted for use with the printing machine, said first replaceable cartridge including, (1) a first container for storing a first selected developer material, and (2) a first programmable memory unit communicating with the control system and being programmed with a first reference value reflecting a desired amount of the first selected developer material to be developed on the photoreceptor, said control system reading the first reference value and determining if a difference exists between the first reference value and the patch value;

(b) wherein the first reference value of said first replaceable cartridge is electronically coupled to the printing machine during a first time interval;

(c) when a difference exists between the first reference value and the patch value, and when the difference is greater than a selected magnitude, adjusting the setpoint of one of the controllable printing machine components;

(d) a second replaceable cartridge, adapted for use with the printing machine, said second replaceable cartridge including, (1) a second container for storing a second selected developer material, and (2) a second programmable memory unit communicating with the control system and being programmed with a second reference value reflecting a desired amount of the second selected developer material to be developed on the photoreceptor, said control system reading the second reference value and determining if a difference exists between the second reference value and the patch value;

(e) wherein the second reference value of said second replaceable cartridge is electronically coupled to the printing machine during a second time interval; and (f) when a difference exists between the second reference value and the patch value, and when the difference is greater than a selected magnitude, adjusting the setpoint of one of the controllable printing machine components.

* * * * *